US009192965B2

(12) United States Patent
Serjeantson et al.

(10) Patent No.: US 9,192,965 B2
(45) Date of Patent: Nov. 24, 2015

(54) PACKAGE VISION SORT SYSTEM AND METHOD

(71) Applicant: Logical Turn Consulting, Inc., Mississauga (CA)

(72) Inventors: Kirk Serjeantson, Markham (CA); David Patrick Short, Ancestor (CA); Adam Stevenson, Hamilton (CA); Jim McLellan, Mississauga (CA)

(73) Assignee: Logical Turn Services Inc., Ontario (CA)

( * ) Notice: Subject to any disclaimer, the term of this patent is extended or adjusted under 35 U.S.C. 154(b) by 0 days.

(21) Appl. No.: 14/175,418

(22) Filed: Feb. 7, 2014

(65) Prior Publication Data

US 2014/0305850 A1 Oct. 16, 2014

Related U.S. Application Data

(60) Provisional application No. 61/761,850, filed on Feb. 7, 2013.

(51) Int. Cl.

| | |
|---|---|
| ***B07C 3/02*** | (2006.01) |
| ***B07C 3/06*** | (2006.01) |
| ***B07C 3/08*** | (2006.01) |
| ***B07C 3/14*** | (2006.01) |
| ***B07C 3/18*** | (2006.01) |
| ***B07C 5/342*** | (2006.01) |
| ***B07C 5/10*** | (2006.01) |

(52) U.S. Cl.

CPC ... *B07C 3/02* (2013.01); *B07C 3/06* (2013.01); *B07C 3/08* (2013.01); *B07C 3/14* (2013.01); *B07C 3/18* (2013.01); *B07C 5/10* (2013.01); *B07C 5/3422* (2013.01)

(58) Field of Classification Search

CPC ..... B07C 5/342; B07C 5/36; B07C 3/00; B07C 3/02; B07C 3/06; B07C 3/08; B07C 3/18; B07C 3/14; B07C 5/3422; B07C 5/10; B07C 1/10

USPC ..... 209/583, 584, 587, 939, 586

See application file for complete search history.

(56) References Cited

U.S. PATENT DOCUMENTS

| | | | | |
|---|---|---|---|---|
| 3,951,264 | A * | 4/1976 | Heidecker et al. | 206/308.3 |
| 5,311,999 | A * | 5/1994 | Malow et al. | 209/583 |
| 7,161,108 | B2 * | 1/2007 | O'Connell et al. | 209/584 |
| 2007/0012603 | A1 * | 1/2007 | Park et al. | 209/584 |
| 2009/0114575 | A1 * | 5/2009 | Carpenter et al. | 209/584 |

* cited by examiner

*Primary Examiner* — David H Bollinger

(74) *Attorney, Agent, or Firm* — Brett A. North; Garvey, Smith, Nehrbass & North, L.L.C.

(57) ABSTRACT

The vision sort system provides a semi-automated sort system that requires no other action from the user other than picking up a box and placing on a skid. The vision sort system is most effective in a manual sort system. The vision sort system integrates various operational technologies in order to provide staff with information to ensure the packages are sorted to the correct destination. Validation feedback is provided to ensure no missorts occur. Information is collected on the package and final destination for tracking purposes. Benefits of the vision sort system include sort accuracy, package visibility, and reduced requirement for sort knowledge by operator and revenue recovery (cube and reweigh) on all packages. This application is perfect for pick and pack systems that are in-motion and any transportation sortation facility. This is applicable for any product including mail or non packaged items.

21 Claims, 15 Drawing Sheets

Cooridnate information

Destination Information

PACKAGE VISION SORT SYSTEM AND METHOD

CROSS-REFERENCE TO RELATED APPLICATIONS

This application claims priority to U.S. Provisional Patent Application No. 61/761,850 filed Feb. 7, 2013, the entirety of which is hereby incorporated by reference for all purposes.

TECHNICAL FIELD

The present disclosure relates to package sort systems and in particular to a semi-automated sort system for sorting freight in logical groups to help facilitate delivery to their final destination.

BACKGROUND

In the transportation industry, packages are processed (scanned and sorted) through different types of sortation areas. There are two major issues with a manual sort system, staff must know where to sort freight (based on postal code or sort code), and freight must be sorted to the correct location or the piece will be missorted causing customer frustration and additional cost to the company. Prior methods are expensive and labour intensive. They also require secondary technology to fulfill tasks such as manual scanners forcing operators to carry objects. Accordingly, system and method that enable improved package sorting remains highly desirable.

BRIEF DESCRIPTION OF THE DRAWINGS

The system and method for package sorting may be better understood with reference to the following drawings and description. The components in the figures are not necessarily to scale, emphasis instead being placed upon illustrating the principles of the disclosure. Moreover, in the figures, like referenced numerals designate corresponding parts throughout the figures.

Further features and advantages of the present disclosure will become apparent from the following detailed description, taken in combination with the appended drawings, in which.

It will be noted that throughout the appended drawings, like features are identified by like reference numerals.

DETAILED DESCRIPTION

In accordance with an aspect of the present disclosure there is provided a method of package sorting, the method comprising: receiving shipping information associated with a package; determining a destination associated with the package; determining dimensioning of the package; identifying a barcode associated with the package; associating the determined dimensions with the package; determining a sort location for the package; displaying the sort location for the package; and determining a placement of the package on sort location.

In accordance with another aspect of the present disclosure there is provided a system for sorting packages, the system comprising: a camera positioned about the conveyor belt for identifying a position of a package on the conveyor belt; a plurality of sort locations each associated with a geographic region for the package destinations; and integration computer coupled to the camera and the plurality of sort location, the integration computer for: determining a destination location of the package; identifying the package on the conveyor belt; identifying a sort location for the package; and displaying an indicator for identifying the placement of the package in the sort location.

In accordance with yet another aspect of the present disclosure there is provided a non-transitory computer readable memory containing instructions for execution by a processor, the instructions for: receiving shipping information associated with a package; determining a destination associated with the package; determining dimensioning of the package; identifying a barcode associated with the package; associating the determined dimensions with the package; determining a sort location for the package; displaying the sort location for the package; and determining a placement of the package on sort location.

Embodiments are described below, by way of example only, with reference to FIGS. 1-14. The vision sort system provides a semi-automated sort system that requires no other action from the user other than picking up a box and placing on a skid. The vision sort system is most effective in a manual sort system. The vision sort system integrates various operational technologies in order to provide staff with information to ensure the packages are sorted to the correct destination. Validation feedback is provided to ensure no missorts occur. Information is collected on the package and final destination for tracking purposes. Benefits of the vision sort system include sort accuracy, package visibility, and reduced requirement for sort knowledge by operator and revenue recovery (cube and reweigh) on all packages. This application is perfect for pick and pack systems that are in-motion and any transportation sortation facility. This is applicable for any product including mail or non packaged items.

Pre-Sort Destination Identification

Figure 1:
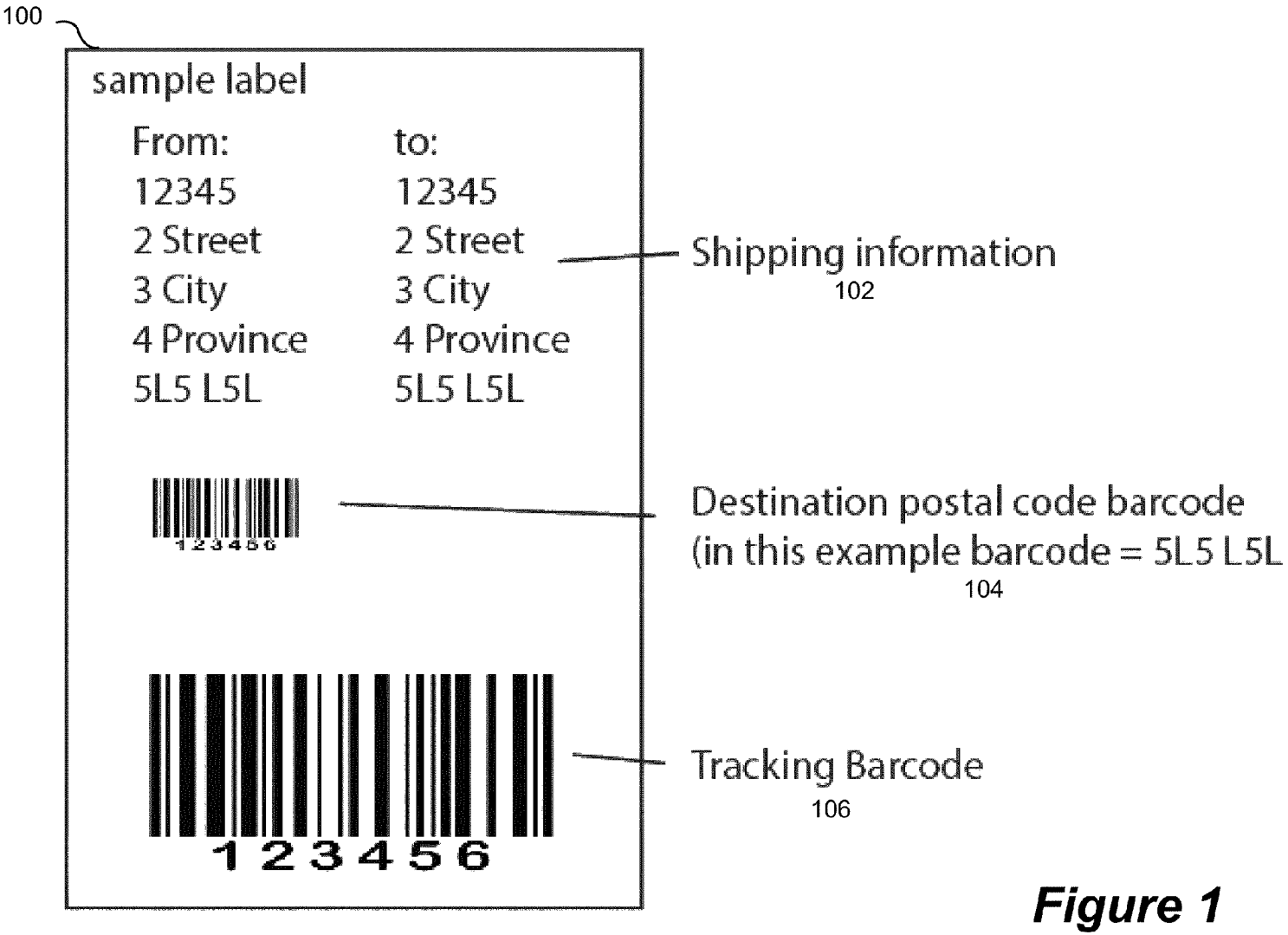
FIG. 1 shows a representation of shipping label.
Figure 2:
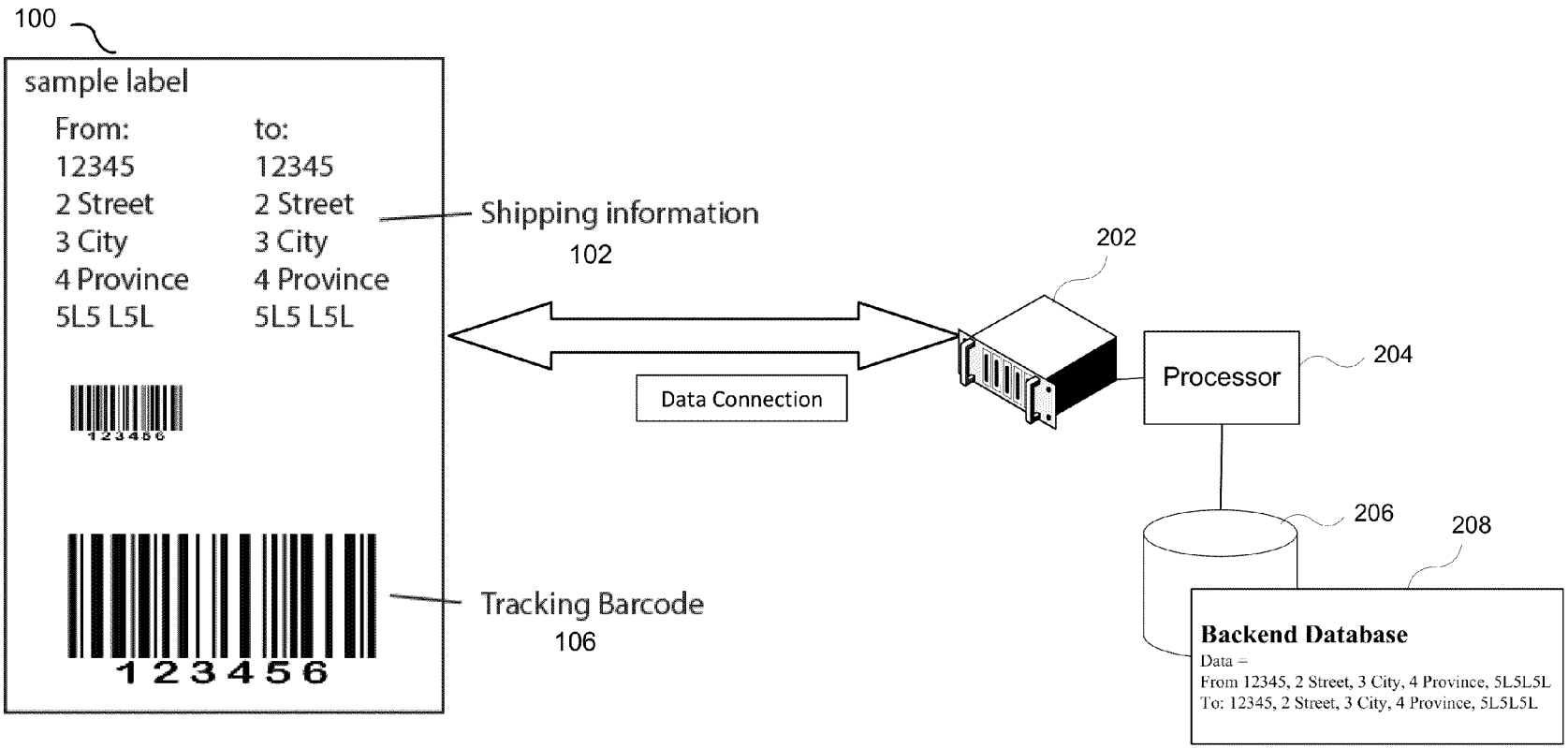
FIG. 2 shows a representation of association of information from the shipping label.

In the transportation industry there is a barcode 106 on a label 100 each box as shown in FIG. 1. The label provides shipping information 102 which is associated with the unique barcode number 106 which allows each individual box to be identified, tracked and billed. For this process to work there must be a connection between the barcode that is on the box and destination information. This can be achieved through one of following functions:

1. Destination barcode available on the box
2. Link between barcode on the box and backend information that identifies destination location
3. Manual application of the destination In FIG. 2, once the barcode 106 is read, the system will go via a network to the backend 202 having at least a processor 204 and a memory execute instructions to extract the destination information 208 from the database 206 stored in a non-transitory memory or network accessible storage to make sort decisions.

The destination of the package is then associated to the barcode. This is achieved by scanning the tracking barcode. The system validates if function 1 or 2 through a scan. If one of the functions exists the box is placed on the belt. If both functions are not available the operator is asked to identify the destination postal code by manually entering the information through and input device. The postal code or zip code and barcode are stored in a database for later use.

Figure 3A:
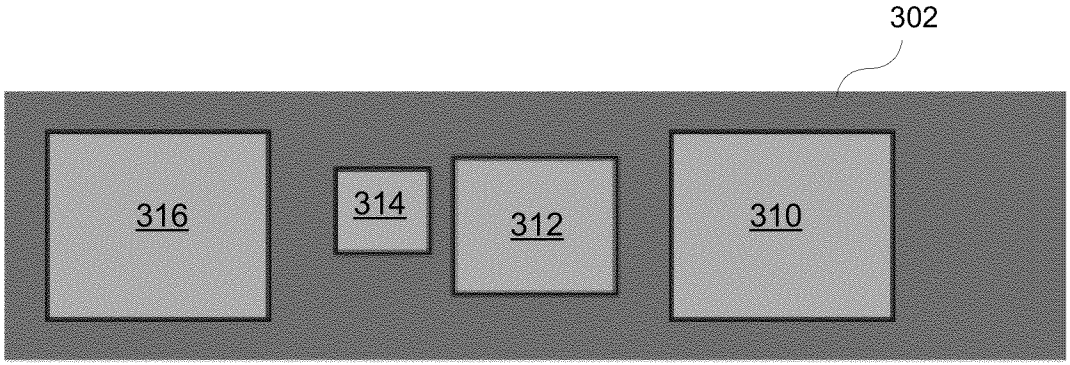
FIGS. 3*a* & 3*b* show representations of package placement on a conveyor belt.
Figure 3B:
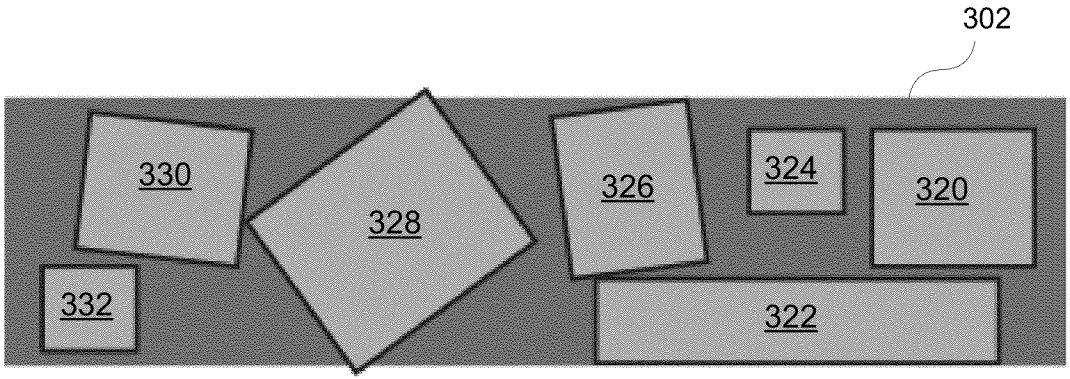

The boxes can be placed on the belt in single file or in chaos as shown in FIG. 3*a* and FIG. 3*b*. In a single file as shown in FIG. 3*a* each box 310-316 is placed on the conveyor belt 302 without vertical overlap. As shown in FIG. 3*b* the chaos flow is defined as non-singulated, non-spaced freight where boxes 320-332 may overlap vertically on the conveyor belt 302 and may placed in varying orientations relative to the movement of the conveyor belt 302.

Figure 4:
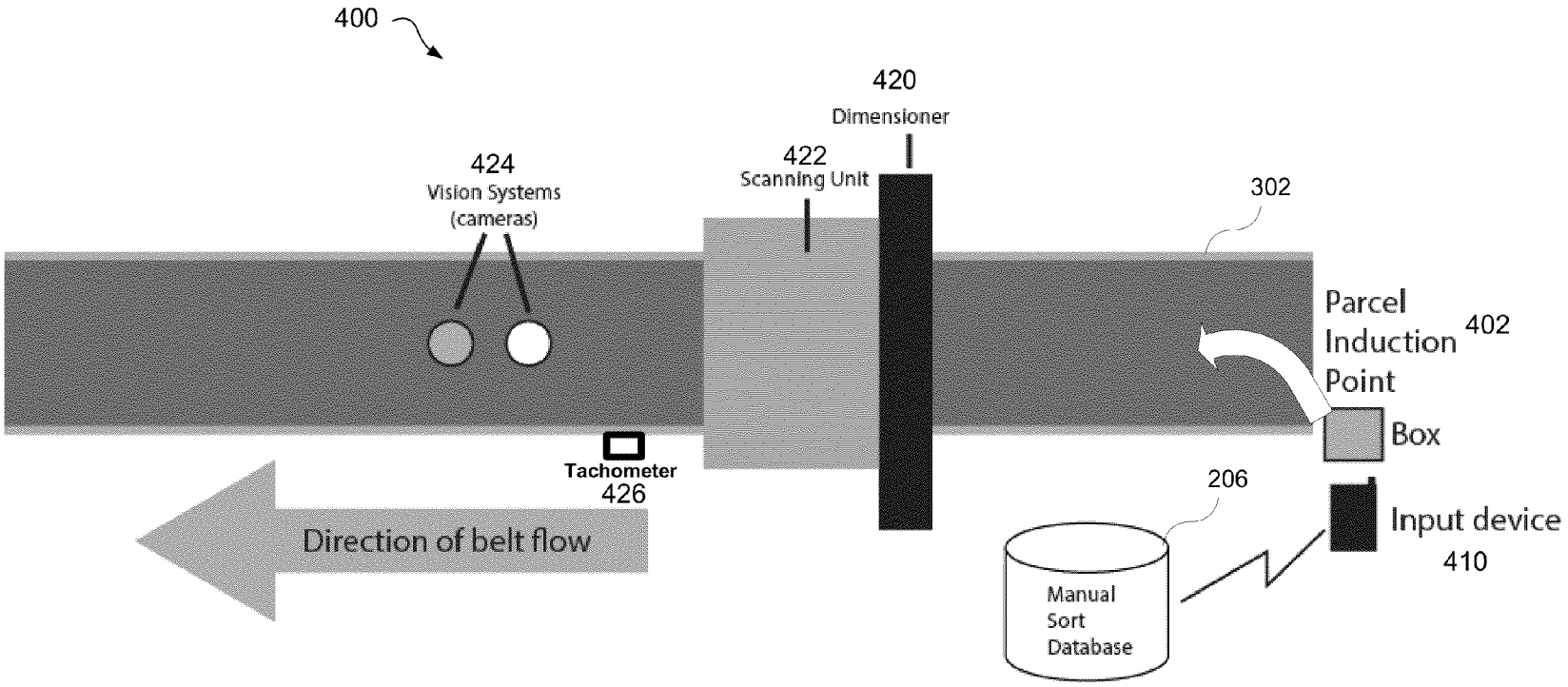
FIG. 4 shows a representation of a vision sortation system.

As shown in FIG. 4, the vision sort system 400 can handle chaos flow but given the reduced complexity of a single file environment it can handle both. The freight represented by boxes are received at a parcel induction point 402. Shipping information associated with the freight is received at an input device 410, such as but not limited to a mobile device, smart phone, personal digital assistant (PDA), and associated with the box in database 206. The barcode 106 is associated with the freight. In chaos, as the freight moves down the belt 302, the freight will pass through the first stage of technology—the dimensioning unit 420 and scanner 422 such as for example Mettler Toledo CS/CSN™ series dimensioners integrated with DataLogic™ scanners, however, any system that can cube and scan in chaos can be integrated into the technology. The dimensioning/scan unit is configured to chaos cubing. Dimensioner/scanner in chaos provides:

1. Determine the corner of each box through patented/proprietary technology as provided by a dimensioning company
2. Determine the length and width of each box through patented/proprietary technology
3. Scan the barcode of on the box through patented/proprietary technology
4. Determine the location of the barcode for each box through proprietary/patented technology
5. Merge the dimensional and scanned information together into a transaction.
6. Store and forward the information.

As the freight passes through this system the corners of each individual box and barcode are captured through the machine. Note that the boxes are used to represent the freight, however the system can work with other shapes, and limitations are solely based on system limitations.

The dimension/scan equipment captures and stores the box dimensions and barcode information for revenue recovery purposes. An additional requirement (and component to the new functionality) is to take the box and barcode coordinate information and pass it to the vision system 424, comprising a first camera 424*a* and a second camera 424*b*.

Integration with Vision System

The coordinate information is stored and tracked through the input of a tachometer 426 which can be provided to the integration system 750. The tachometer 426 measures the movement of the belt 302. Through integrating the tachometer with the coordinate information, the corners of the box and barcode location can be tracked along the belt.

Mounted after the dimensioning/scanning equipment are cameras 424, the numbers of vision units are dependent on the size of the belt.

As the freight/boxes move down the belt images of the belt 302 with freight/boxes is captured by the camera 424*a*. Images are taken at regular intervals and stored in the integration system 750. Software is then used to take the coordinate information from the dimensioner/scanner unit and overlay it with the image from the vision camera.

Figure 5A:
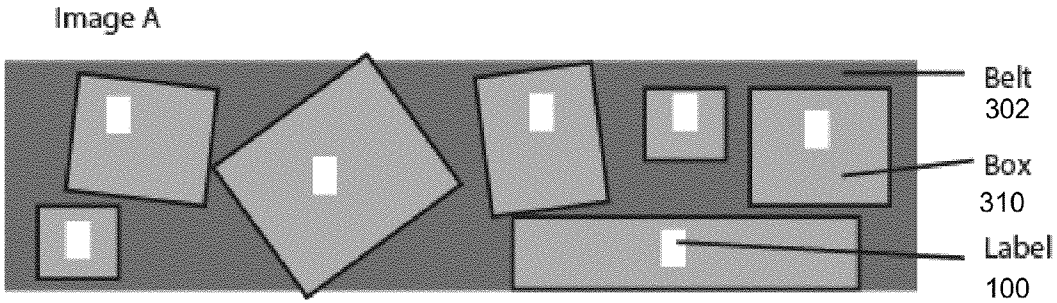
FIGS. 5*a*-5*c* show representations of identification of packages on the conveyor belt.
Figure 5B:
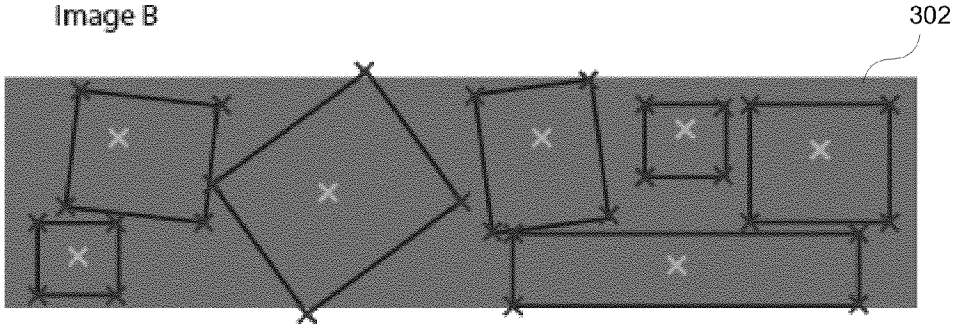
Figure 5C:
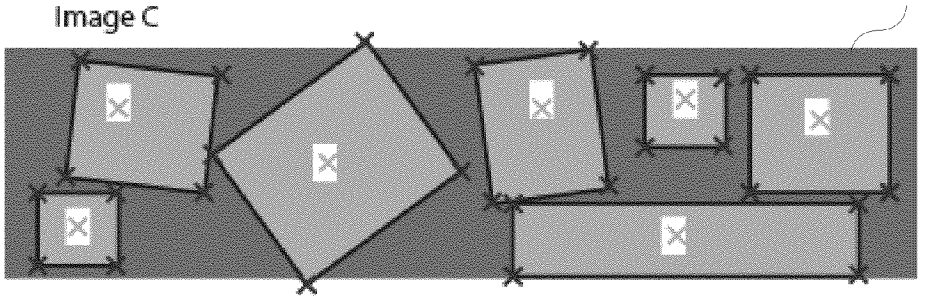

FIG. 5*a* represents the image taken by the vision system 424. FIG. 5*b* represents the information passed by the dimensioner 420. FIG. 5*c* represents the integration of the tachometer information and the resulting combination of both sets of information.

The resulting image of FIG. 5*c* allows boxes being processed in chaos to be identified in an image. In image of FIG. 5*c* the Xs represent the barcode information (unique identification of each box) and the available dimensional information.

Sort Location Identification

Figure 6:
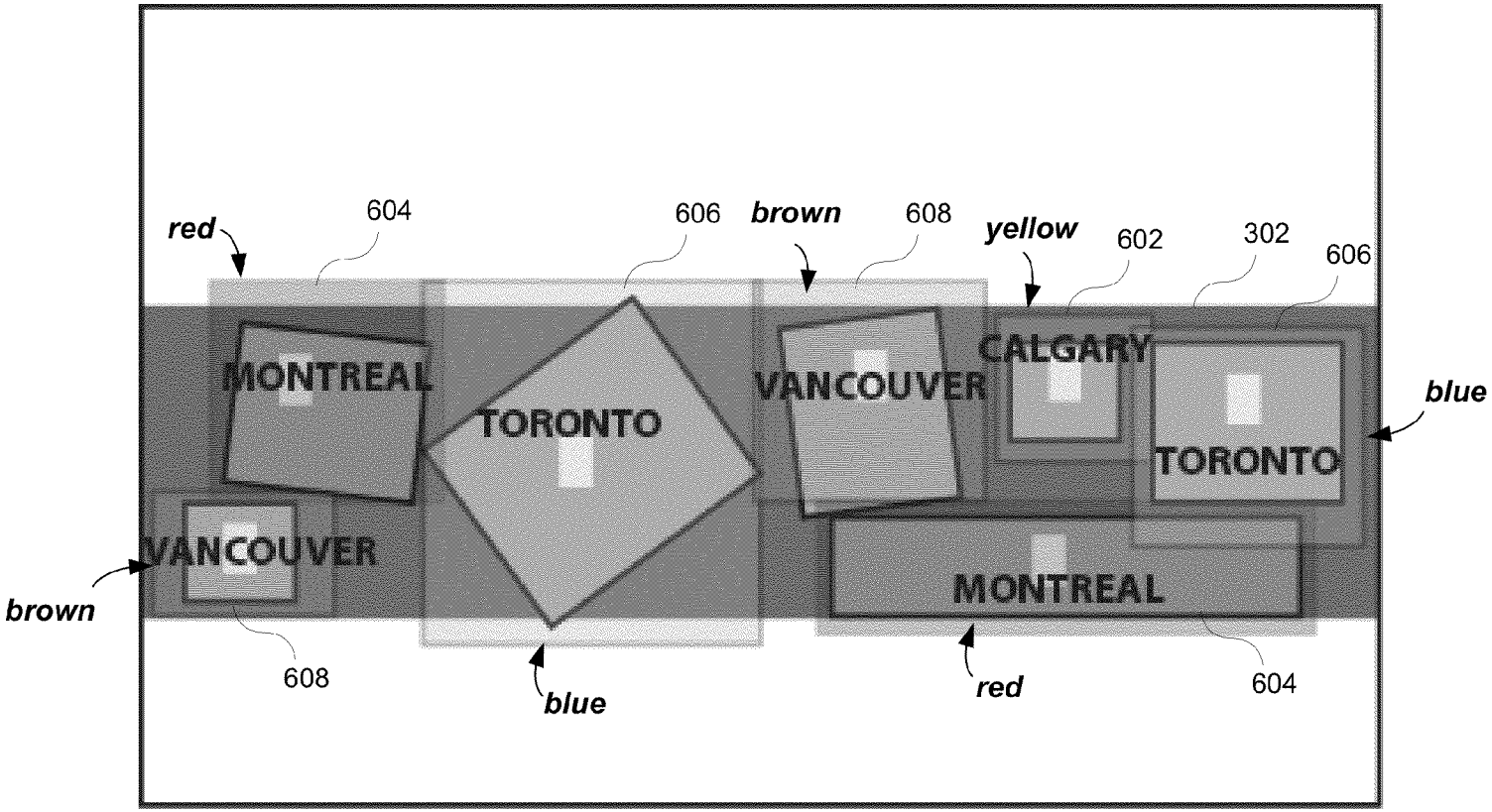
FIG. 6 shows a representation of a sorters video screen.

With each box clearly identified in the image from the combination of dimensional scan and image information the process can now start sorting. By pulling and integrating the information from Pre-sort Identification Phase, that information can now be married to the barcode, dimensions and parcel image. This is then represented to the sorters on a video screen as shown in FIG. 6 providing a color coded overlay of the boxes. The vision image camera output coupled with the color coded and labelled destination allows the user to select a package and understand final destination location. The city associated with the destination of each package would be color coded, for example all packages destined for Calgary would be yellow 602, Montreal would be red 604, Toronto would be Blue 606, and Vancouver would be Brown 608.

Successful Sort Feedback

The system does not just know the final destination of the package but also knows when the package is removed from the belt and to know that particular package was placed on the appropriate sort location destination.

Figure 7:
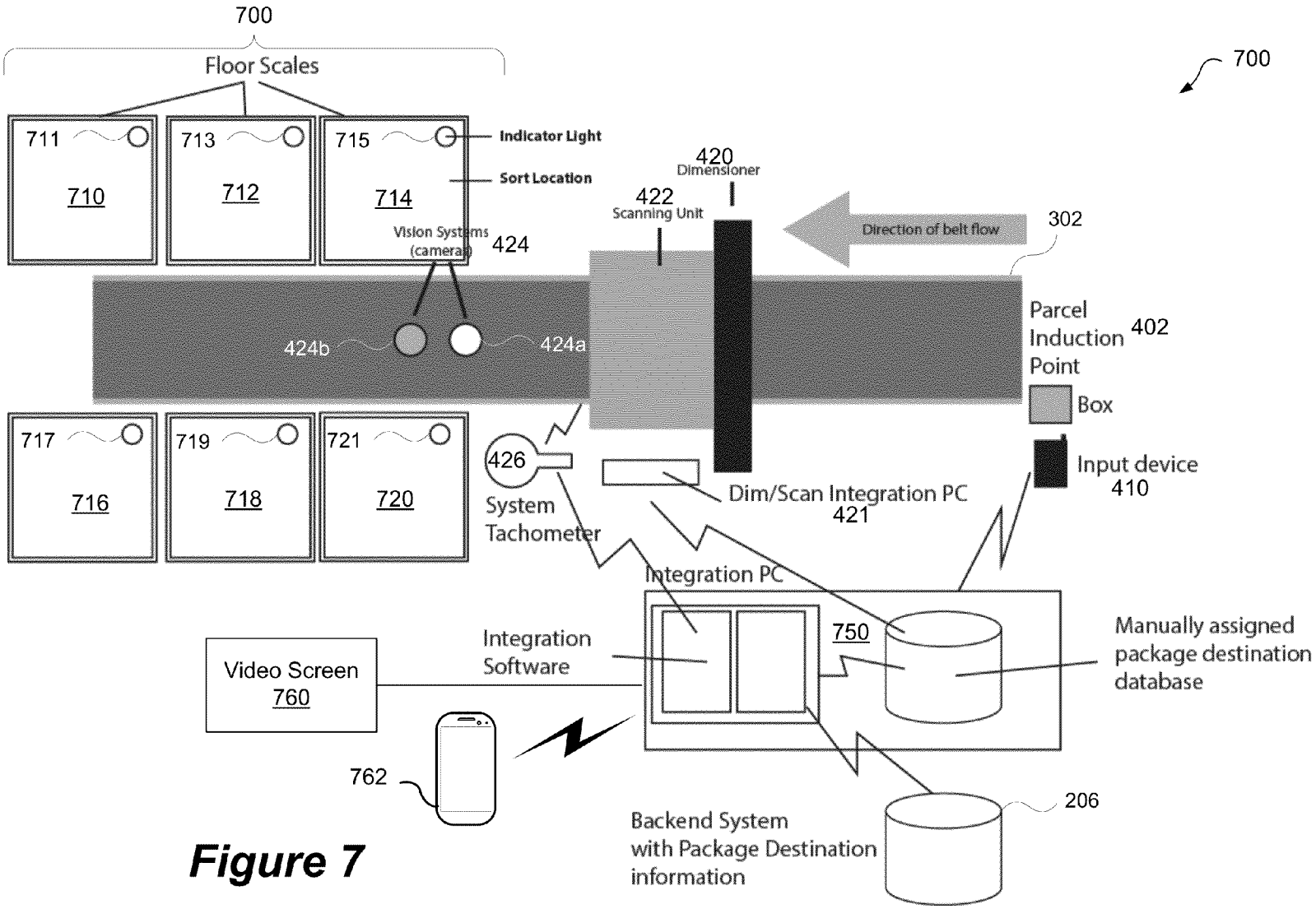
FIG. 7 shows a representation of the vision sortation system with the sort locations.

FIG. 7 represents a typical sort setup. Sort setups can range in number of sort locations 710, 712, 714, 718, 720 depending on the company and sortation requirements for a particular building. Each sort location has an indicator light 711, 713, 715, 719, 722 to identify to the operator where the package should be placed. These locations will all be configurable but for the sake of this example a six position sort is shown.

Recognizing a Package has been Removed

Figure 8A:
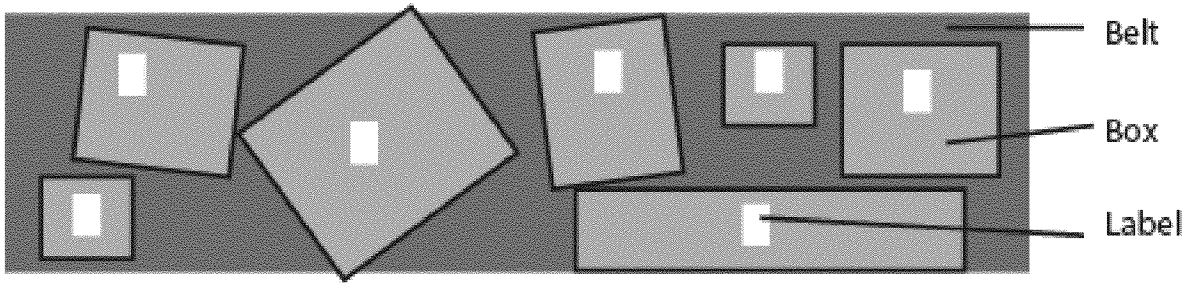
FIGS. 8*a*-8*d* illustrate the recognition that a package has been removed.
Figure 8B:
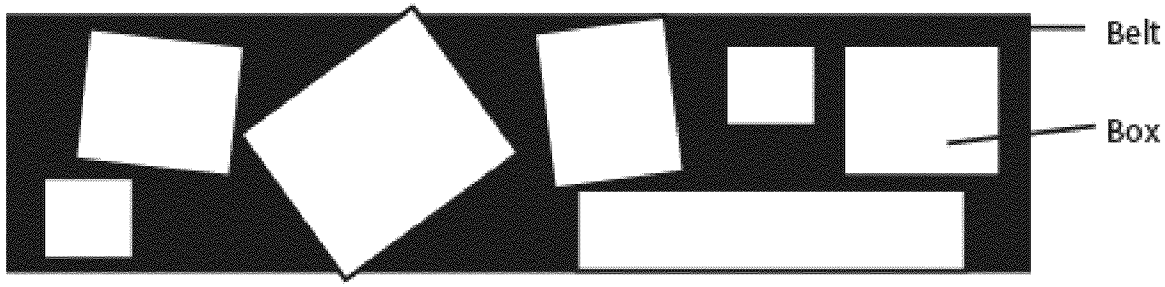

For the system to recognize a package has been removed the vision system camera 424*b* is initiated. The vision video selection camera 424*b* captures images of the belt. This camera is configured to focus on the color of the belt. If there is a box on the belt this color differentiation is noted and recognized by the camera. FIG. 8*a* highlights this variation and represents a top down view of what is happening on the belt. FIG. 8*b* represents what the vision selection camera sees. Although two cameras are described the functions may be provided by a single camera.

Figure 8C:
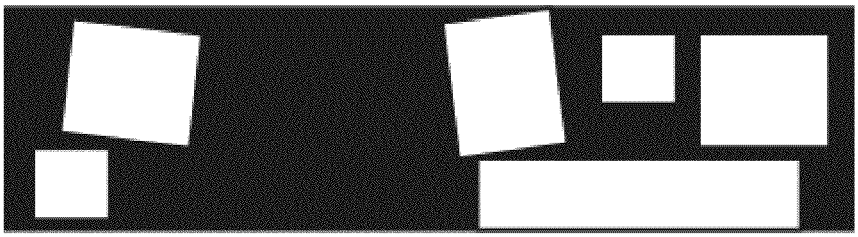
Figure 8D:
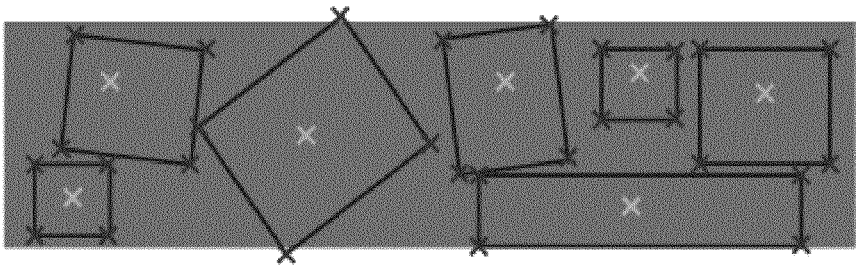
Figure 8D:
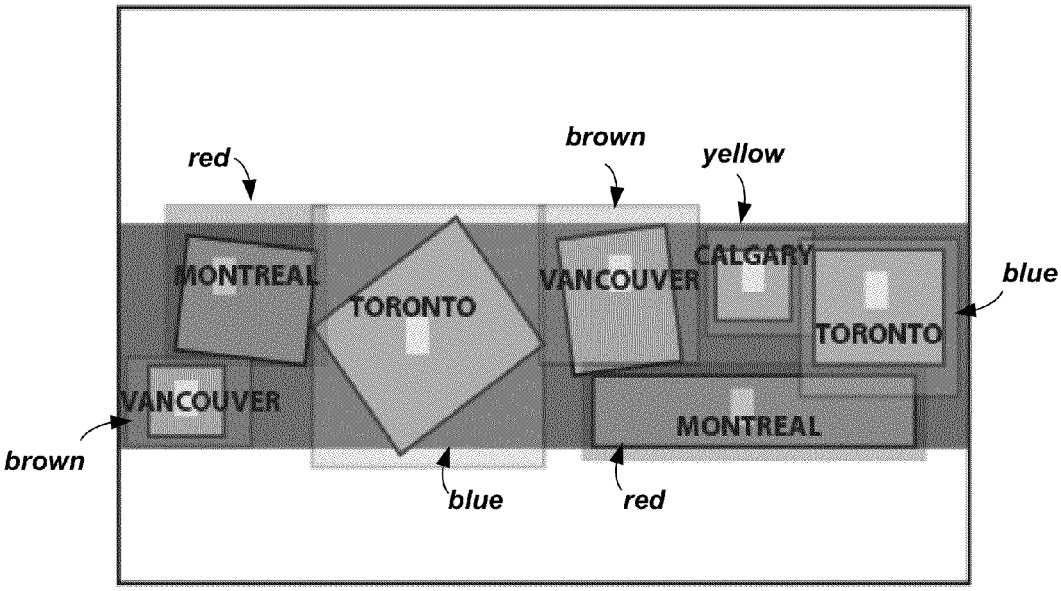

The vision selection camera sends this data to an integration system 750. The integration system 750 is networked with the scanning unit 422, dimensioner 420 via dim/scan integration PC 421 or a computer interface. The integration software executed by the integration system 750 provides control/instructions for the sort locations 710, 712, 714, 718, 720 for enabling the indicator associated indicator lights 711, 713, 715, 719, 722 and receiving information from the associated scales. The integration computer comprises at least a processor, memory and network interface for provide wired network capability but may also provide directly or indirectly wireless interfaces with components of the system or for receiving date from input device or the operator. The integration computer then overlays this data with the data from the dimensioner 420 and scan system 422 (box and barcode coordinates). When a box is removed, the vision selection camera identifies a change in the color variation as seen in FIG. 8*c* (shown in greyscale with identified colors). The integration system knows that the parcel that has been removed because of an output from the vision selection camera. The integration system 750 now associates this information with the information on the sort screen as seen FIG. 8*d* and is provided on a video display 760 visible to the sorter which may also provide a touch interface to enable the operator to select page and request identification of associated sort location. The package that has been removed is destined for Toronto. Alternatively a smartphone or tablet device 762 may be utilized to display output from the system to identify real-time sort schema to the operator.

Figure 9:
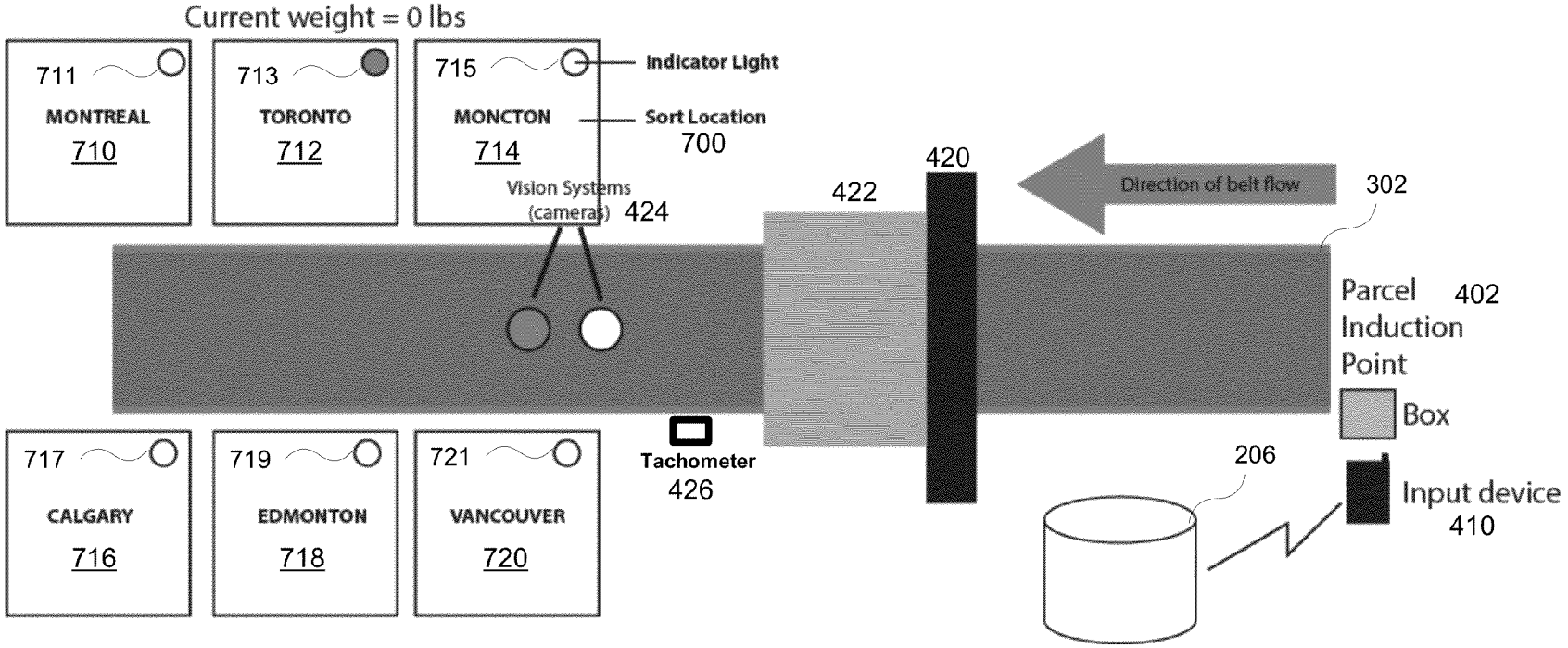
FIG. 9 shows a representation of the vision sortation system with a sort location indicator illuminated.

Once the system recognizes which destination the removed box is destined for, the system turns on a light 713 as shown in FIG. 9 to identify this location to the operator. Each destination location rests on a scale. The scale associated with each sort location knows the box has been placed onto the correct sort destination so long as the scale in question receives a weight increase.

Figure 10:
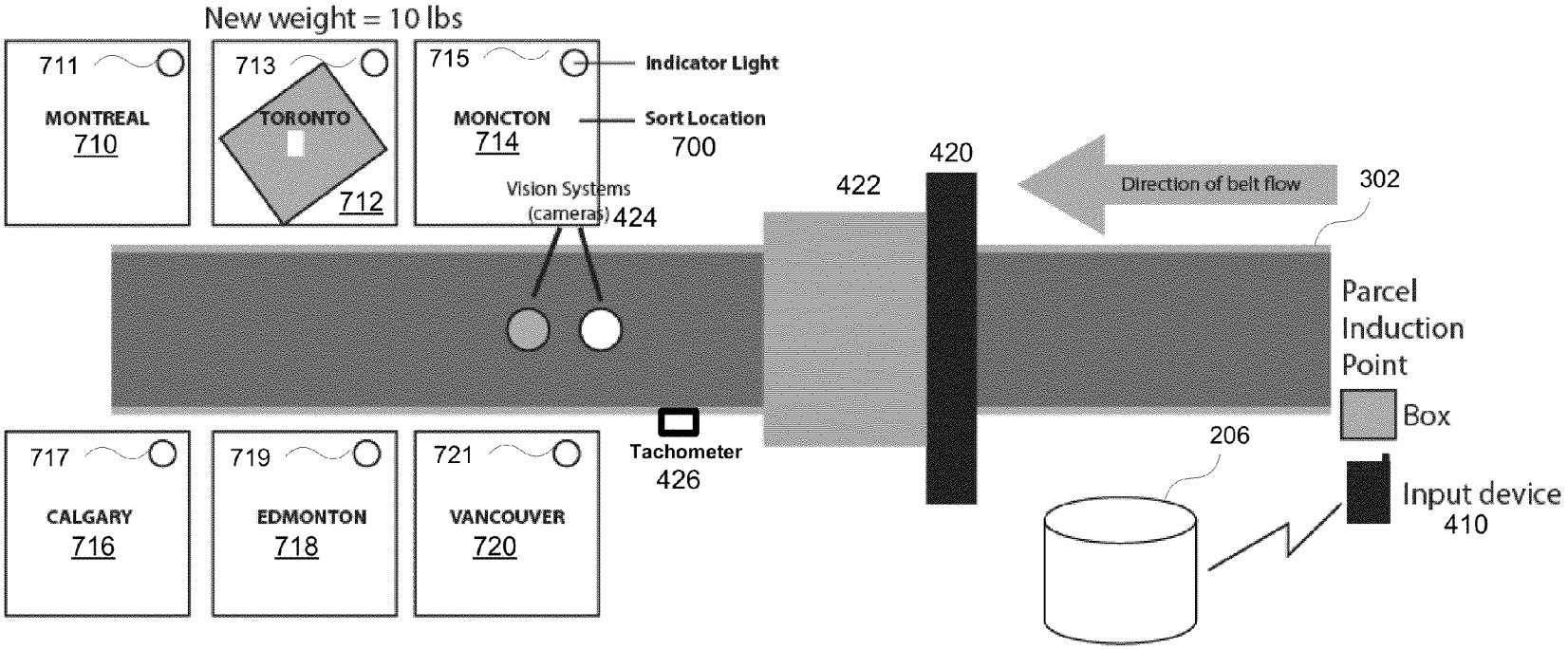
FIG. 10 a representation of the vision sortation system with a package placed in the sort location.

As shown in FIG. 10, as new packages are added to the different destinations, there is a verification the box has been sorted correctly. If a box is sorted incorrectly (placed on the wrong sortation destination location) an alert is sent to the user through the graphical interface.

The scale is not used only to identify correct sortation location, but is the scale is also used to collect package weight. This is done through an incrementing weight process. As weight is added to the destination location the difference between the original weight and the new weight is subtracted to determine the weight of the sorted package. For example, if 5 packages have been sorted to the Moncton destination location and the total weight is 100 lbs. If package 6 is added to the destination location and the new weight is 110 lbs the system will apply a weight of 10 lbs to the barcode associated to that package. The system inserts the weight into the data string created by the dimensioner (earlier in the process) in the appropriate field.

An advantage of this system is the reduction in cost for the equipment and the reduced time it takes to sort a package. The reduction in equipment is the elimination of peripheral hand scanners and the reduction in time is by eliminating the need to scan the packages. In other systems, the package would need to be scanned prior to being sorted. The system would then do a look up. In this system the package is simply removed from the conveyor.

Figure 11:
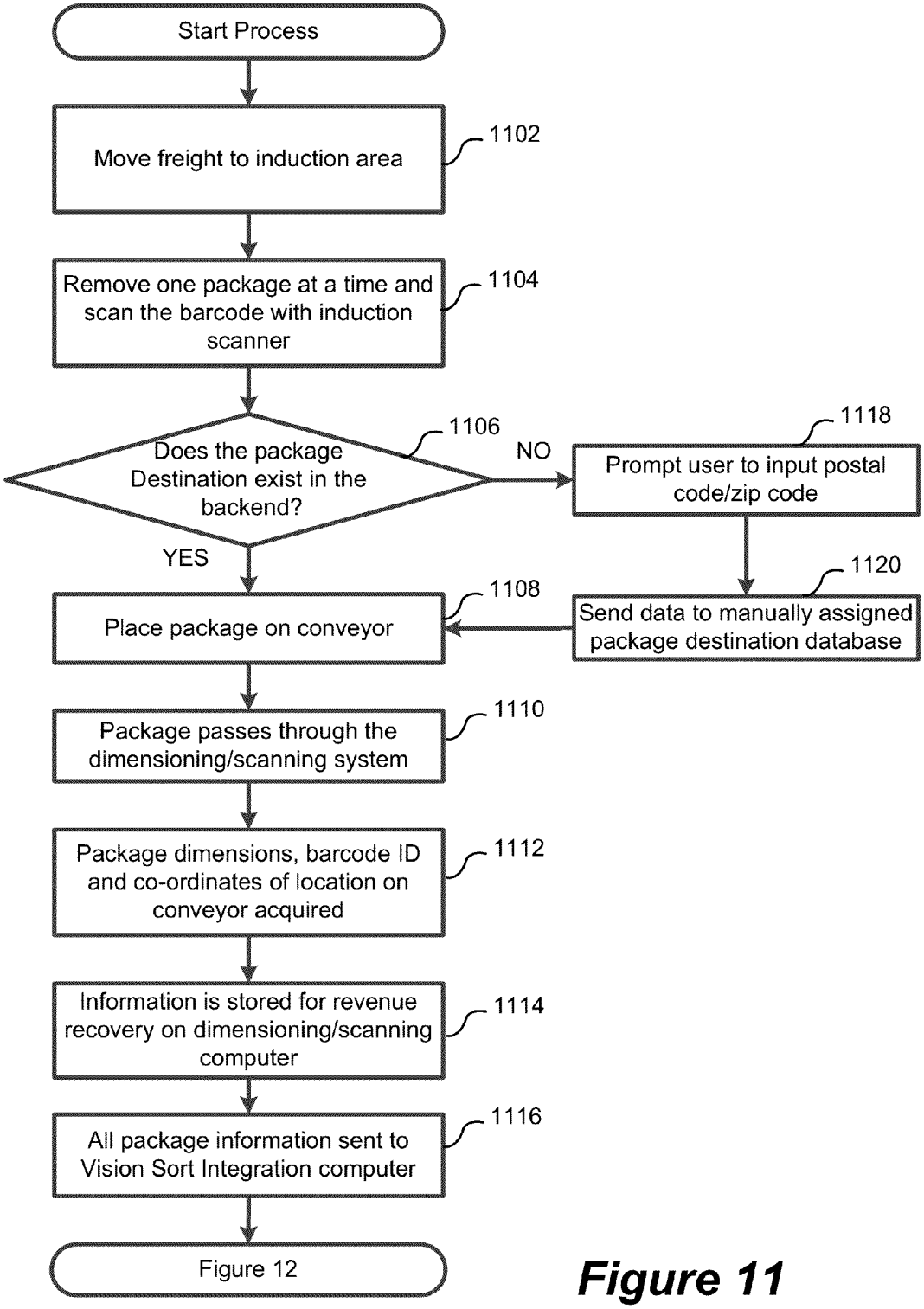
FIGS. 11-14 shows a method of operating a semi-automated sort system.

FIG. 11 shows a method of operating a semi-automated sort system. The method commences with the freight/boxes are moved to the parcel induction point (1102). The barcode for each piece is scanned with an induction scanner (1104). If backend destination exists, (YES at 1106) the operator is prompted to place freight/package on the belt (1108). If backend destination information does not exist, (NO at 1106) the operator is prompted to enter the postal code/zip code or other identifying destination information based on sort schema into the input device (1118). The input device sends this data to the manually assigned package destination database (1120) and the operator is prompted to place freight/package on the belt (1108). The package passes through the dimensioner/scanning system and the freight/box dimensions (1110) and barcode ID are acquired along with the coordinate information for each box and for each barcode (1112). This information is stored for revenue recovery in the dimensioner/scanner integration computer (1114) as per the normal system function, but is also sent to the integration computer and kept in the system database (1116).

Figure 12:
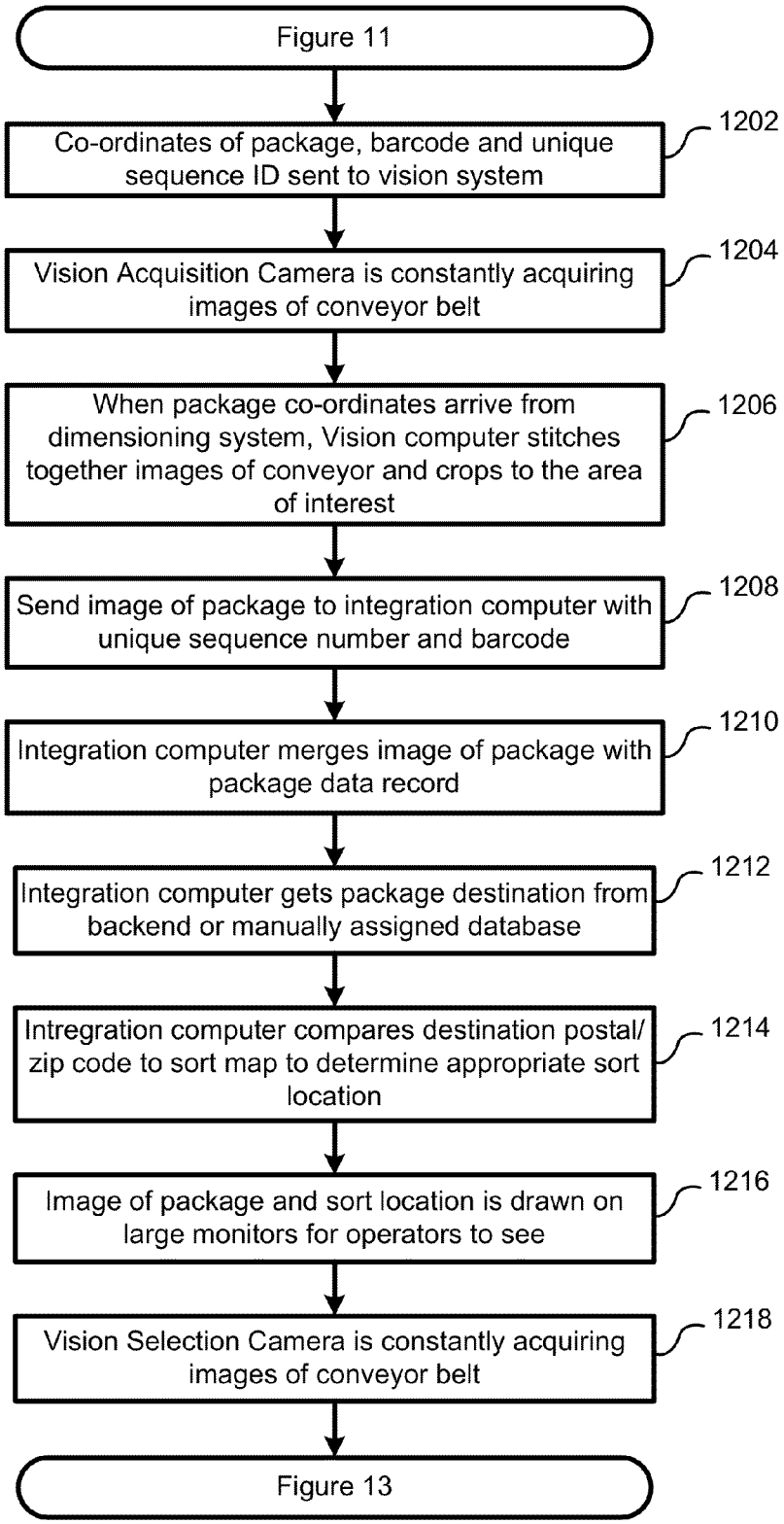
Figure 13:
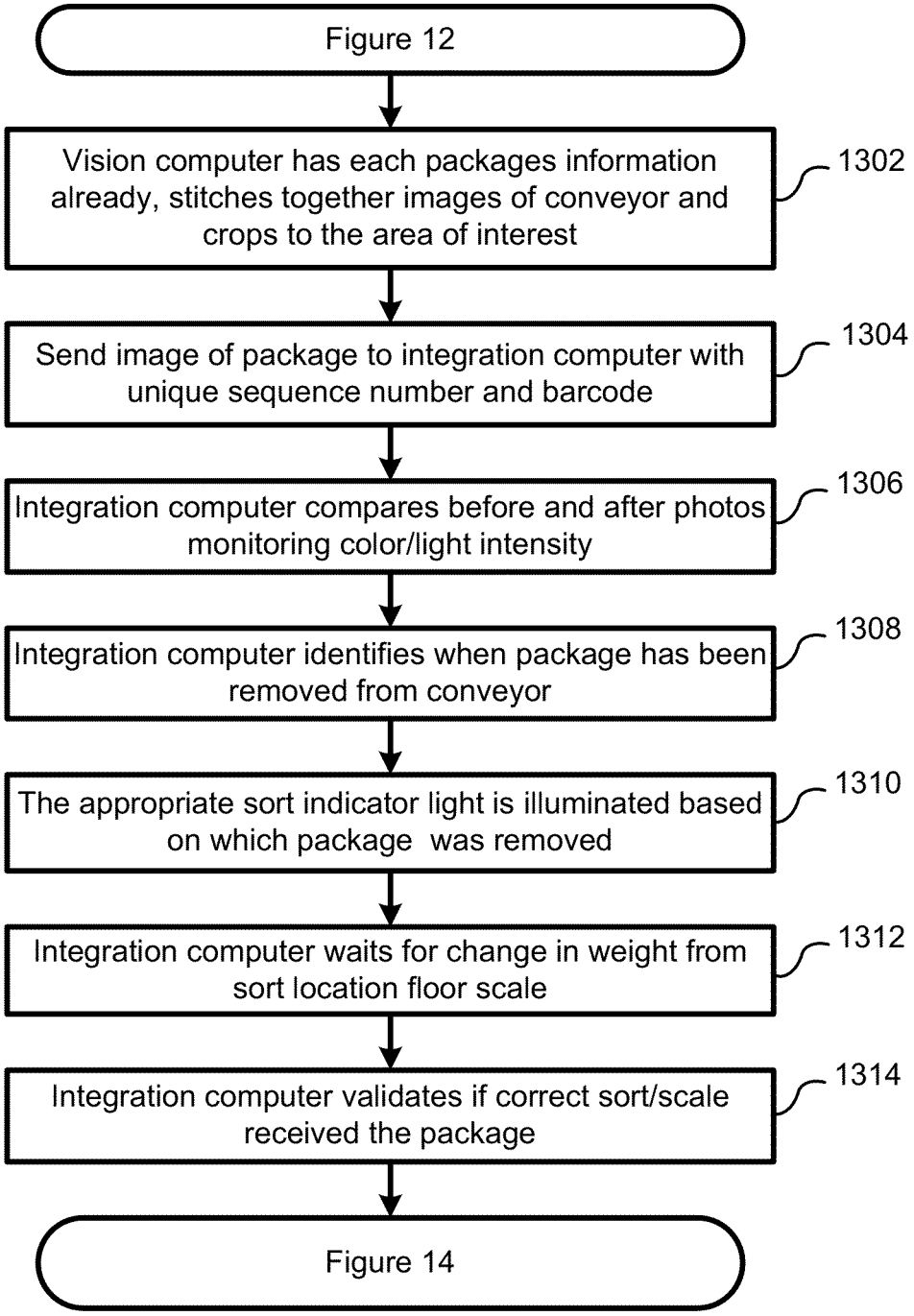

As shown in FIG. 12, the co-ordinates of the package, barcode and unique sequence ID are sent to the vision system (1202). The freight/boxes then pass through the vision systems; first, the vision image acquisition camera (1204) being a fixed focus camera that is taking constant images of a defined area of the belt and freight. The images are sent to the integration computer which aligns the coordinate information from the dimensioner/scanning system with the image acquisition system to uniquely identify each piece (1206). The image of the package is sent to the integration computer with the unique sequence number and barcode (1208). The integration computer merges image of the package with the package data record (1210). The integration computer then draws from either the manually assigned package destination database or the backend system with package destination database to associate the appropriate destination information to the appropriate barcode/dimension and image (1212). The integration computer compares the destination postal/zip code to sort map to determine appropriate sort location (1214). The image and destination information is outputted to a large monitor(s) where the operator staff can see where each package is to be sorted to (1216). The vision selection camera is a fixed focus camera taking constant images of the belt (1218). This camera is looking for color changes within the images to identify if a package has been removed from the belt As shown in FIG. 13, the vision computer has information for each package already and stitches together images of the conveyor and crops to the area of interest (1302). The image of the package is sent to the integration computer with unique sequence numbers and barcodes (1304). The integration computer compares before and after photos monitoring color and light intensity (1306). When a package is removed (identified by color input changes from the vision selection camera) (1308) the integration computer identifies the location destination for that package based on the previous processes by illuminating the appropriate sort indicator light (1310). The system waits for a change in weight from one of the floor scales and the floor scale with the change in weight is sent to the integration computer (1312). Integration computer validates if the appropriate box was placed in the appropriate destination location (1314).

Figure 14:
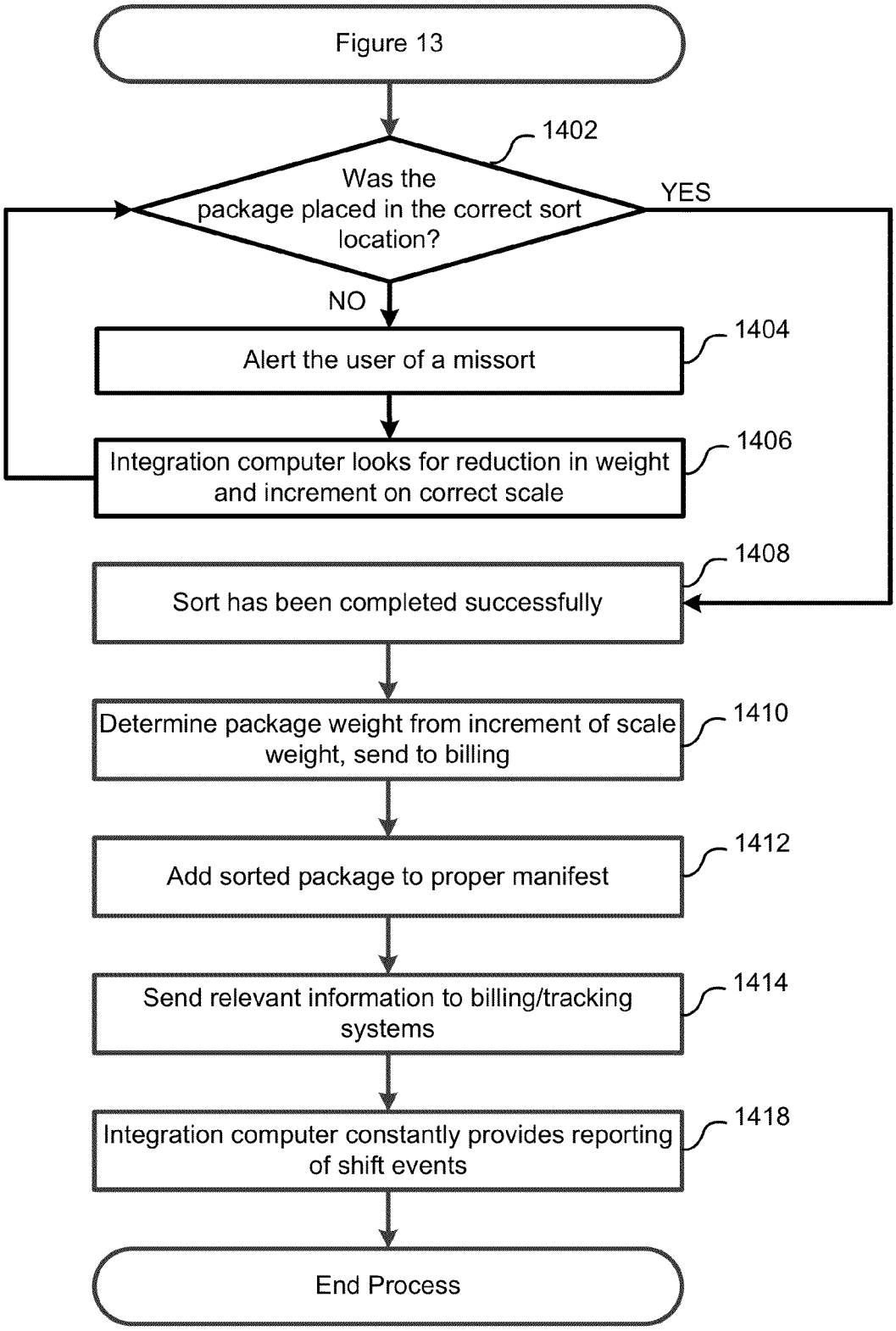

As shown in FIG. 14, if the box is placed on the incorrect sort destination (NO at 1402) an alert is sent to the user (1404). The integration computer looks for a reduction in weight and increment in weight from the incorrect destination station to the correct destination station (1406). If the box is placed on the correct sort destination (YES at 1402) the sort has been successfully completed (1408). Once the proper inputs are received the integration computer determines the parcel weight (through subtraction of the original destination location weight from the new destination location weight) (1410). Adds the sorted package to the proper manifest (1412). Sorts the relevant information to billing/tracking systems (1414) and provide reporting of shift events (1418).

The system could be designed without the vision system using hand scanners. Once a barcode is scanned post-dimensioner/scanner the destination look-up would be trigged by a barcode scan event.

The system could be infused with a mass flow reweigh scale. This inclusion would allow multiple boxes to be removed from the belt at the same time. This would be made possible by matching the destination location weight with the weight provided by the in-line chaos weighing system.

It will be appreciated that not all possible embodiments have been described in detail. However, having regard to the current description, it will be appreciated how to modify the embodiments described in detail herein to provide the features and functionality of other possible embodiments. The devices, systems and methods described herein have been described with reference to various examples. It will be appreciated that systems, devices, components, methods and/or steps from the various examples may be combined together, removed or modified. As described the system may be implemented in one or more hardware components including a processing unit and a memory unit that are configured to provide the functionality as described herein. Furthermore, a computer readable memory, such as for example electronic memory devices, magnetic memory devices and/or optical memory devices, may store computer readable instructions for configuring one or more hardware components to provide the functionality described herein.

In some embodiments, any suitable computer readable memory can be used for storing instructions for performing the processes described herein. For example, in some embodiments, computer readable media can be transitory or non-transitory. For example, non-transitory computer readable media can include non-volatile computer storage memory or media such as magnetic media (such as hard disks), optical media (such as compact discs, digital video discs, Blu-ray discs, etc.), semiconductor media (such as flash memory, read only memory (ROM), Flash memory, electrically programmable read only memory (EPROM), electrically erasable programmable read only memory (EEPROM), etc.), any suitable media that is not fleeting or devoid of any semblance of permanence during transmission, and/or any suitable tangible media.

Although the description discloses example methods and apparatus including, among other components, software executed on hardware, it should be noted that such methods and apparatus are merely illustrative and should not be considered as limiting. For example, it is contemplated that any or all of these hardware and software components could be embodied exclusively in hardware, exclusively in software, exclusively in firmware, or in any combination of hardware, software, and/or firmware. Accordingly, while the following describes example methods and apparatus, persons having ordinary skill in the art will readily appreciate that the examples provided are not the only way to implement such methods and apparatus.

The invention claimed is:

1. A method of package sorting, the method comprising:
receiving shipping information associated with a package;
determining a destination associated with the package;
determining dimensioning of the package;
Identifying a barcode associated with the package;
associating the determined dimensions with the package;
determining a sort location for the package;
displaying the sort location for the package; and
determining a placement of the package on sort location.

2. The method of claim 1 wherein the sort location is associated with a barcode on the package.

3. The method of claim 2 wherein the dimensioning of the package is performed by a dimension unit and a scanner over a conveyor belt on which the package passes.

4. The method of claim 3 wherein determining the sort location is determined by a camera of a conveyor belt on which the package.

5. The method of claim 4 wherein displaying the sort location is determined by mapping an image received by the camera to a determined destination associated with the sort location.

6. The method of claim 5 wherein displaying the sort location is on a video display showing a sort location associated with the package destination.

7. The method of claim 6 wherein the sort location is associated with a color identifier on the video display.

8. The method of claim 5 further comprising activating an indicator over a sort location when a package is removed from the conveyor belt, the sort location associated with the destination of the package.

9. The method of claim 8 wherein the indicator associated with a respective sort location is activated when the packaged is placed on an incorrect sort location or when the package is placed on a correct location.

10. The method of claim 5 further comprising a scale associated with each sort locations weight change when box is placed on a sort location, the scale used to determine that a correct package has been placed at the sort location.

11. The method of claim 10 further comprising assigning a differential of the weight change to the package when removed from the conveyor belt, the differential assigned to the determined sort location and used to determine when the package is placed at a correct sort location.

12. A system for sorting packages, the system comprising:
a camera positioned about a conveyor belt for identifying a position of a package on the conveyor belt;
a plurality of sort locations each associated with a geographic region for package destinations;
a dimensioner and a scanner unit positioned over the conveyor belt on which the package passes; and
an integration computer coupled to the camera, dimensioner, scanner unit and the plurality of sort locations, the integration computer for:
determining a destination location of a package;
identifying the package on the conveyor belt;
identifying a sort location for the package from the plurality of sort locations; and
displaying an indicator for identifying a placement of the package in the identified sort location.

13. The system of claim 12 further comprising a video display for displaying the sort location associated with the package destination.

14. The system of claim 13 wherein the sort location is associated with a color identifier on the video display.

15. The system of claim 12 further comprising activating an indicator over one of the plurality of sort locations when a package is removed from the conveyor belt.

16. The system of claim 15 wherein the indicator is activated at the associated sort location when the packaged is placed on an incorrect sort location.

17. The system of claim 16 further comprising a scale associated with each sort locations weight change when box is placed on a sort location, the scale used to determine that a correct package has been placed at the sort location.

18. The system of claim 17 further comprising assigning a differential of the weight change to the package when removed from the conveyor belt, the differential assigned to the identified sort location and used to determine when the package is placed at a correct sort location.

19. The system of claim 18 wherein displaying an indicator of the sort location is determined by mapping an image received by the camera to a determined destination.

20. The system of claim 12 further comprising determining the sort location is by associating a barcode on the package with a sort location.

21. A non-transitory computer readable memory containing instructions for execution by a processor, the instructions for:

receiving shipping information associated with a package;
determining a destination associated with the package;
determining dimensioning of the package;
identifying a barcode associated with the package;
associating the determined dimensions with the package;
determining a sort location for the package;
displaying the sort location for the package; and
determining a placement of the package on sort location.

* * * * *